United States Patent [19]

Roth

[11] Patent Number: 4,776,185

[45] Date of Patent: Oct. 11, 1988

[54] DEVICE FOR PERIODIC OFFSET DISPLACEMENT OF THE GUIDE BAR OF A WARP KNITTING MACHINE

[75] Inventor: Karl Roth, Naila, Fed. Rep. of Germany

[73] Assignee: Liba Maschinenfabrik GmbH, Naila, Fed. Rep. of Germany

[21] Appl. No.: 106,417

[22] Filed: Oct. 6, 1987

[30] Foreign Application Priority Data

Oct. 6, 1986 [DE] Fed. Rep. of Germany ..... 3634021

[51] Int. Cl.[4] ..... D04B 23/00

[52] U.S. Cl. ..... 66/207

[58] Field of Search ..... 66/207

[56] References Cited

U.S. PATENT DOCUMENTS

| | | | |
|---|---|---|---|
| 2,782,617 | 2/1957 | Noe | 66/207 |
| 3,099,920 | 8/1963 | Liebrandt et al. | 66/207 |
| 3,247,686 | 4/1966 | Lanithier | 66/207 |
| 4,092,838 | 6/1978 | Gangi | 66/207 |

*Primary Examiner*—Ronald Feldbaum

*Attorney, Agent, or Firm*—Dority & Manning

[57] ABSTRACT

Device for the offset displacement between two end positions, at which its offset movement is reversed, of a warp knitting machine guide bar shifted horizontally by a guide bar shaft and holding the yarn guides. A buffer is provided for at least one of the end positions, said buffer acting as an elastic stop with a short buffering path with respect to the needle division before the yarn guides can run up against the knitting needles.

4 Claims, 1 Drawing Sheet

DEVICE FOR PERIODIC OFFSET DISPLACEMENT OF THE GUIDE BAR OF A WARP KNITTING MACHINE

BACKGROUND OF THE INVENTION

The instant invention relates to a device for periodic offset displacement of a guide bar of a warp knitting machine displaced by a guide bar shaft and holding the yarn guides between two end positions at which the offset movement of the guide bar is reversed.

The offsetting of the guide bar of a warp knitting machine is normally effected by means of a so-called pattern wheel or a pattern disk which has cam-like projections and thereby produces a shifting movement in a roller which follows the steps of the pattern wheel as the wheel rotates, said shifts being transmitted via a push rod to the guide bar. A device designed according to this principle is shown in U.S. Pat. No. 3,008,314, for example. In this case, care must be taken for the roller to be constantly in contact with the contoured surface of the pattern wheel, and this is normally ensured by means of a counterspring which acts upon the guide bar so that the latter presses against the push rod in direction of the pattern wheel (e.g. see German Patent No. 1,281,091). The higher the operating speed of the warp knitting machine, the higher is also the rotational speed of the pattern wheel. However, since the offset movement of the guide bar is short in relation to a work cycle of the warp knitting machine, the projections of the pattern wheel have relatively steep slopes. The above-mentioned counterspring must therefore act upon the guide bar with great prestressed force to prevent the offsetting speed imparted to the guide bar at the forward slope of a projection from causing brief lifting of the cam follower from the surface of the pattern wheel. The cam follower and therefore the guide bar would then carry out an excessive offset movement, so that the yarn guides held by the displaced guide bar could impact against the knitting needles. The greater the force developed by the counterspring with which the cam follower is pressed against the pattern wheel, the more energy must be produced to rotate the pattern wheel and furthermore the force of the pressure causes corresponding wear of the cam follower and of the pattern wheel. It has been shown in practice that such an excessive offset movement of the guide bar also occurs as the follower moves along a rear slope of a projection of the mirror disk, even though the configuration of the pattern wheel should not permit this. The reason for this excessive offset movement is found in the unavoidable elasticity of the components involved, namely of the push rod inserted between the guide bar and the cam follower and of the guide bar itself. Finally, a certain amount of elasticity in the bearings supporting the pattern wheel is also unavoidable. Because of the possible occurrence of such an excessive offset movement, the top operating speeds of warp knitting machines are limited.

It is the object of the instant invention to increase the speed of warp knitting machines with offset movement of the guide bar as indicated above. The object is achieved according to the invention in that a buffer is provided for at least one outer end position, said buffer acting as an elastic stop with a short buffered course in relation to the needle division before the yarn guides can run up against the knitting needles.

Normally, an excessive offset movement in the sense of the above explanation occurs mainly in the area of the forward slopes of the pattern wheel projections, so that the installation alone of the buffer at the end position involved makes it possible to increase the operating speed of the warp knitting machine. There is, however, also the possibility that the back slopes of the pattern wheel projections are the most dangerous locations in this sense, as completely different elasticity conditions may prevail within the machine depending upon the design of the warp knitting machine involved, and these elasticity conditions are furthermore so complex in nature that they cannot be calculated in advance.

Consequently, it is also possible and rational to provide possibly only a buffer for the end position which is attributed to a rear flank of the pattern wheel projections. In this case too, the operating speed of the warp knitting machine concerned can be increased. In addition, the safety with which the yarn guides are prevented from running up against the knitting needles is further increased in every case. This safety is ensured especially if a buffer is provided for each of the two end positions.

In any case, the buffer is an elastic stop and because of the shortness of its buffer path in relation to the needle division, it ensures that the guide rod is prevented from making an excessive offset movement so that impacting of the yarn guides against the knitting needles is safely prevented. It is furthermore possible, thanks to the arrangement of the buffers, to decrease the force of the counterspring considerably, since dangerous lifting of the cam follower from the surface of the pattern wheel is counteracted especially by the corresponding buffer.

In this connection, the existing state of the art is disclosed by the German patent No. 34 39 426. In such patent a fast running warp knitting machine is described in which a slider-crank mechanism causes the offset movement of the guide bars and in which the guide bars are in a manner held in their normal position by springs acting against each other so that when a guide bar is offset, one of the springs is put under tension and the other spring is relaxed. It is the purpose of this measure to bring the inertia forces occurring with the offset movement into a dynamic equilibrium with the forces of the springs, i.e. to transform the kinetic energy into spring energy and vice versa in each case. This method has no bearing upon the above-mentioned problem of yarn guides running up against knitting needles, and neither does the publication concerned mention this problem.

The springiness of the stop can be ensured by an arrangement by which said stop bears against an adjustable prestressed helical spring. It is, however, also possible to make the stop itself of a rubber-like material. In either case, the stop can be made to recede over a short buffer path in relation to the needle division, so that a hard impact of the guide bar against such a buffer is avoided.

The buffer is preferably installed on the guide bar shaft so that it is displaced together with the latter. The buffer then follows the same horizontal-swing movement as the portion of the guide bar which interacts with said buffer, so that no relative movement occurs between these parts. This is an advantage for the construction design of the machine.

BRIEF DESCRIPTION OF THE DRAWING

Examples of embodiments of the invention are shown in the drawings where.

DESCRIPTION OF A PREFERRED EMBODIMENT

Figure 1:
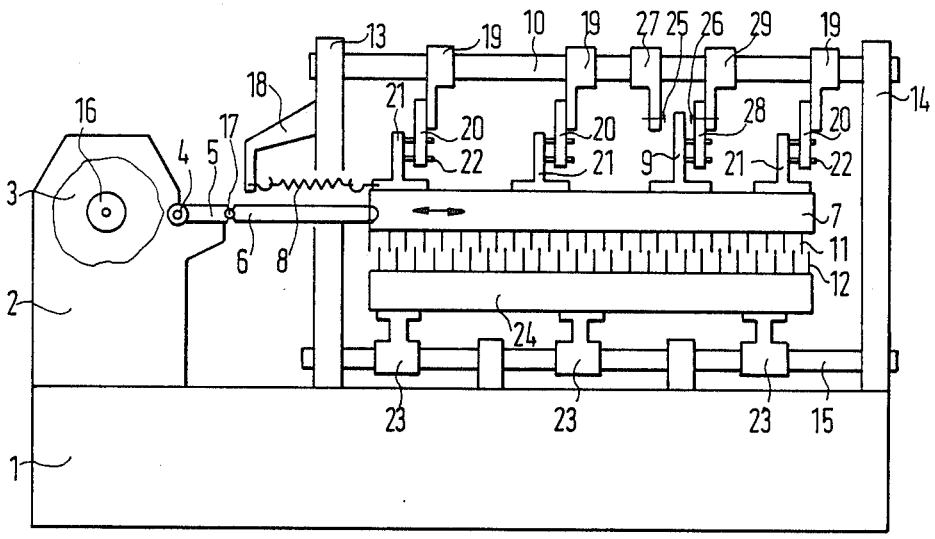
FIG. 1 is a schematic drawing of a warp knitting machine over a guide bar capable of being displaced by means of a pattern disk or wheel.

FIG. 1 is a schematic drawing of the required basic components of a warp knitting machine with the basic frame 1, the pattern motion drive 2 and the two side walls 13 and 14. The two side walls 13 and 14 support the guide bar shaft 10 and the needle bar shaft 15. The pattern motion drive 2 supports the pattern wheel 3 on an axle 16.

The cam follower 4 which is located at the end of the so-called slide 5 runs on the pattern wheel 3. The slide 5 is then connected via ball-and-socket joint 17 to the push rod 6 which acts directly upon the guide bar 7 and moves it back and forth in a known manner in function of the projections of the pattern wheel 3 as shown by the double arrow in the drawing. The tension spring 8 which is held between side wall 13 and arm 18 acts upon guide bar 7. The tension spring 8 exerts a pull from the guide bar 7 in direction of the pattern wheel 3. The tension spring 8 thus acts as the earlier-mentioned counterspring and ensures that the cam follower 4 is pressed against the pattern wheel 3.

The guide bar shaft 10 carries out a back-and-forth rotational movement in a known manner and this movement is translated into a back-and-forth swinging movement via the arms 19 attached on the guide bar shaft 10 and via the supports 20 attached to the arms 19. The supports 20 take along the guide bar holders 21 in this movement, whereby the guide bolt indicated by lines 22 ensures in an also known manner that the guide bar can be shifted back and forth in its longitudinal direction into any possible horizontal-swing position.

Levers 23 are attached on the needle bar shaft 15 and transmit a back-and-forth turning motion originating at the needle bar shaft 15 which is transmitted to the needle bar 24, and thereby moves the knitting needles 12 accordingly. Facing the knitting needles 12 are the yarn guides 11 which are held by the guide bar 7.

In order to limit the displacement of the guide bar 7 so that the yarn guides 11 cannot impact upon the knitting needles 12, two buffers 25 and 26 are provided, and between these a bracket 9 attached to the guide bar 7 moves back and forth in accordance with the rotation of the pattern wheel 3. The two buffers 25 and 26 are attached to the guide bar shaft 10, buffer 25 via arm 27 and buffer 26 via support 28 and arm 29. The support 28, just as is the case with support 20 and guide bolt 22, permits a shifting of bracket 9 in the longitudinal direction of the guide bar 7 without any changes occurring in the horizontal-swing angles assumed respectively by support 28 and bracket 9.

As the pattern wheel 3 rotates, the cam follower 4 is moved back and forth in accordance with the projections, whereby a corresponding slaving movement of the guide bar 7 results. The limits of movement of the guide bar 7 are then normally determined by extent of the projections of the pattern wheel 3, but here the buffers 25 and 26 provide additional protection to ensure that the movement of the guide bar 7 does not exceed the displacement limits set by said buffers.

Figure 2:
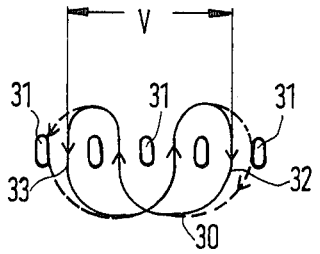
FIG. 2 is a schematic drawing of a laying operation with two end positions in which the movement of displacement of the guide bar is reversed.

FIG. 2 is a schematic representation of the path 30 travelled by a yarn guide around the knitting needles 31 and shows the effect of the buffers 25 and 26 according to FIG. 1. The yarn guide (not shown) follows a movement along a path indicated by line 30, said movement reversing itself at its outer end positions 32 and 33 with respect to its offset movement. The desired and correct offset is indicated with the letter V in FIG. 2. In addition to the path of movement 30, which is the desired path of movement, the broken lines near the end positions 32 and 33 represent an offset movement of the yarn guide in question that would go too far. By following this path shown in a broken line, the yarn guide in question would come into contact with the knitting needles 31, and this is absolutely prevented by the buffers 25 and 26 mentioned in the discussion of FIG. 1.

Figure 3:
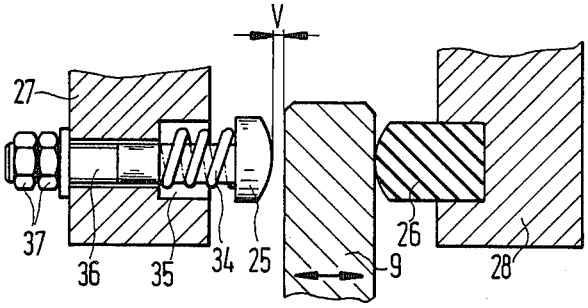
FIG. 3 shows two limit stops of which one bears against a helical spring and of which the other is made of rubber.

The configuration of the buffers is now explained in greater detail through FIG. 3. FIG. 3 shows the bracket 9 which is moved back and forth between buffers 25 and 26 in function of the offset movement of guide bar 7. Buffer 25 therefore acts here as an elastic limit stop because it bears upon the end of bore 35, on the side facing away from buffer 25. Bore 35 reaches into arm 27 and extends as far as the side of arm 27 facing away from buffer 25, thus constituting an open passage. Buffer 25 constitutes the head of bolt 36 which is positioned in relation to arm 27 by means of the two counter nuts 37. The relative position of buffer 25 with respect to arm 27 can be adjusted by means of said two counter nuts 37, with the helical spring 34 always being prestressed.

To show yet another embodiment of a buffer, buffer 26 is constructed differently from buffer 25. Buffer 26 is in this case a chunk of rubber embedded in a corresponding blind pocket in arm 28.

In the position of bracket 9 as shown here, it is in contact with buffer 26 and thus leaves the offset path V between itself and buffer 25 open.

The prestress inherent to buffers 25 and 26 is sufficiently great so that when the bracket 9 impacts upon one of these buffers, the latter can give only slightly, i.e. permits a buffered path that is so short that the yarn guides cannot come into contact with the knitting needles. Since the buffers 25 and 26 exert such a limiting action upon the offset movement of the guide bar, traction spring 8 of FIG. 1 need not exert especially strong traction upon the guide bar.

What is claimed is:

1. Device for the offset displacement between two end positions at which its offset movement is reversed of a warp knitting machine guide bar shifted horizontally by a guide bar shaft and holding the yarn guides, characterized in that a buffer is provided for at least one outer end position, said buffer acting as an elastic stop with a short buffering path with respect to the needle division before the yarn guides can run up against the knitting needles.

2. Device as in claim 1, characterized in that the stop bears against an adjustable, prestressed helical spring.

3. Device as in claim 1 or 2, characterized in that the stop is made of a rubber-like material.

4. Device as in one of the claims 1 or 2, characterized in that the buffer is installed on the guide bar and is displaced horizontally together with the latter.

* * * * *